US009481140B2

(12) United States Patent
Lee et al.

(10) Patent No.: US 9,481,140 B2
(45) Date of Patent: Nov. 1, 2016

(54) APPARATUS FOR MANUFACTURING COSMETICS, COMPRISING CONTENTS ABSORPTION STEP USING ABSORBENT

(75) Inventors: Inchul Lee, Seoul (KR); Gyeongho Kim, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 422 days.

(21) Appl. No.: 14/238,252

(22) PCT Filed: Jul. 30, 2012

(86) PCT No.: PCT/KR2012/006047

§ 371 (c)(1),
(2), (4) Date: Feb. 11, 2014

(87) PCT Pub. No.: WO2013/024982

PCT Pub. Date: Feb. 21, 2013

(65) Prior Publication Data

US 2014/0170253 A1 Jun. 19, 2014

(30) Foreign Application Priority Data

Aug. 12, 2011 (KR) ..... 10-2011-0080746

(51) Int. Cl.
*B30B 11/08* (2006.01)
*B30B 15/24* (2006.01)
(Continued)

(52) U.S. Cl.
CPC ..... *B30B 9/04* (2013.01); *A45D 33/00* (2013.01); *B30B 11/06* (2013.01); *B30B 11/14* (2013.01); *B30B 15/0082* (2013.01); *A45D 2200/1018* (2013.01); *A45D 2200/1036* (2013.01)

(58) Field of Classification Search
CPC ..... G01N 33/57415; G01N 33/57496; G01N 2440/14; G01N 2800/56; B29C 43/006; B29C 43/02; B29C 37/001
USPC ..... 425/78, 352, 410–412; 264/109, 123
See application file for complete search history.

(56) References Cited

U.S. PATENT DOCUMENTS 4,884,601 A * 12/1989 Hatakeyama ..... B30B 15/302 100/90
4,962,627 A * 10/1990 Gueret ..... B65B 1/24 53/412

(Continued)

FOREIGN PATENT DOCUMENTS

KR 10-2006-0117653 A 11/2006
KR 10-2009-0008802 A 1/2009
KR 20-0452741 Y1 3/2011

OTHER PUBLICATIONS

International Search Report of PCT/KR2012/006047 dated Feb. 7, 2013.

*Primary Examiner* — Joseph S Del Sole
*Assistant Examiner* — Thukhanh T Nguyen

(57) ABSTRACT

The apparatus for manufacturing cosmetics comprises the contents absorption step using an absorbent including: (1) a transfer table for transferring a cosmetic container, (2) a suction portion for sucking foreign matter inside an accommodation space of the cosmetic container, (3) a contents injection portion for injecting contents into the accommodation space, (4) an absorbent supply portion for injecting an absorbent into the accommodation space, (5) an absorbent press portion for repeatedly pressing the absorbent inside the accommodation portion, (6) an edge member supply portion for injecting an edge member for fixing the absorbent inside the accommodation space, and (7) an absorbent fixing portion for allowing the edge member to be fixed inside the accommodation space.

8 Claims, 8 Drawing Sheets

(51) Int. Cl.

| | |
|---|---|
| ***B30B 9/04*** | (2006.01) |
| ***A45D 33/00*** | (2006.01) |
| ***B30B 11/14*** | (2006.01) |
| ***B30B 15/00*** | (2006.01) |
| ***B30B 11/06*** | (2006.01) |

(56) References Cited

U.S. PATENT DOCUMENTS 5,406,990 A * 4/1995 Haeberli ..... B65B 63/02 141/101
5,449,481 A * 9/1995 Sagawa ..... B22F 3/1233 264/109
6,048,419 A * 4/2000 Guerin ..... B22F 3/03 100/246
6,358,448 B1 * 3/2002 Green ..... B29C 43/006 264/109
8,708,002 B2 * 4/2014 Malenke ..... B65B 1/36 141/129
2012/0139164 A1 * 6/2012 Ishikawa ..... B30B 11/022 264/442
2015/0232208 A1 * 8/2015 Kim ..... B65B 3/30 141/20.5

* cited by examiner

APPARATUS FOR MANUFACTURING COSMETICS, COMPRISING CONTENTS ABSORPTION STEP USING ABSORBENT

CROSS REFERENCE RELATED APPLICATION

This application claims foreign priority of Korean Patent Application No. 10-2011-0080746, filed on Aug. 12, 2011, which is incorporated by reference in its entirety into this application.

TECHNICAL FIELD

The present invention relates to a cosmetics manufacturing apparatus having a function of kneading contents and an absorbent, and more particularly to a cosmetics manufacturing apparatus including a process of absorbing contents by an absorbent by which a process of absorbing relatively viscous contents by an absorbent is applied to all products at the same intensity every time and the process is completely automated, so that an absorption degree of contents to the absorbent of the manufactured cosmetics can be always constantly maintained within a predetermined error range.

BACKGROUND ART

In general, types of cosmetics used in makeup include a makeup base, powder, two-way cake, a powder pact, and a skin cover, and a user selects suitable types according to his or her tastes, characteristics of skin, and makeup type.

Here, the makeup cosmetics are generally manufactured by injecting a powder material containing oil substances and pressing the powder material with a press. The makeup cosmetics are generally compressed into a solid form. In the process of manufacturing makeup cosmetics that are power, carriers in which a cosmetics container is held are sequentially fed by a feeding unit including a conveyor belt. In the process of feeding the carriers, a process of introducing a material containing oil substances into a cosmetics container, a process of pressing the material introduced into the cosmetics container with a press, and a process of discharging oil from the material of the cosmetics container are sequentially processed. The cosmetics container in which oil substances are removed from its material is withdrawn.

Meanwhile, products functioning mainly to block ultraviolet rays generally referred to as a sun block have been recently provided, and the sun block cosmetics include makeup bases or products having other makeup functions. Since the sun block products can block ultraviolet rays and solve basic makeup at the same time, makeup time can be reduced and light summer makeup can be achieved, which is preferable.

However, since the conventional cosmetics including an ultraviolet ray blocking function is manufactured by completely manually performing a process of introducing contents into a container and fixing the container, its productivity is not high in spite that much manpower is consumed in the manufacturing process. For this reason, much manpower is necessary during a mass production of cosmetics and thus manufacturing costs increase and product prices rise due to labor costs.

Some conventional cosmetics including an ultraviolet ray blocking function are manufactured by absorbing contents in an absorbent such as sponge. Here, an absorption degree of contents to an absorbent may be different according to skills or concentration of an operator, which makes the quality of the cosmetics uneven. That is, considering that a uniform quality of a finally manufactured product is a very important factor when the product is manufactured, a dispersion of the quality of cosmetics becomes large if a process of absorbing contents to the absorbent is completely manually performed, which may cause complaints of a consumer and a degradation of a product in spite that cosmetics of a good quality are manufactured.

Although dust and various foreign substances are introduced into cosmetics containers n a process of feeding the containers, they cannot be manually wiped one by one in the process of ultraviolet ray blocking function cosmetics and thus contents are directly introduced into the cosmetics container. This causes degradation of a quality of cosmetics and expedites a change of a quality of cosmetics due to the contaminant substances containing foreign substances.

DISCLOSURE

Technical Problem

Accordingly, the present invention has been made in an effort to solve the above-described problems, and it is an object of the present invention to provide a cosmetics manufacturing apparatus including a process of absorbing contents by an absorbent by which a process of absorbing relatively viscous contents by an absorbent is applied to all products at the same intensity every time and the process is completely automated, so that an absorption degree of contents to the absorbent of the manufactured cosmetics can be always constantly maintained within a predetermined error range.

It is another object of the present invention to provide a cosmetics manufacturing apparatus including a process of absorbing contents by an absorbent by which a process of suctioning foreign substances from a cosmetics container before contents and an absorbent are introduced, a finally produced product can be basically protected from a degradation of the product due to foreign substances as the corresponding process is performed through an automation process, and an unmanned process can be performed without consuming labor power.

Technical Solution

In accordance with an aspect of the present invention, there is provided a cosmetics manufacturing apparatus comprising a process of absorbing contents by an absorbent, the apparatus including: a feeding table by which a cosmetics container is fed; a suction unit for suctioning foreign substances from an accommodation space of the cosmetics container; a contents injection unit for injecting contents into the accommodation space from which the foreign substances are suctioned by the suction unit; an absorbent supply unit for introducing an absorbent into the accommodation space into which the contents are injected by the contents injection unit; an absorbent pressing unit for repeatedly pressing the absorbent and absorbing the contents into the absorbent; a edge member supply unit for introducing a edge member for fixing the absorbent to the accommodation space into the accommodation space; and an absorbent fixing unit for fixing the edge member to the accommodation space while the edge member presses and fixes a circumference of the absorbent.

The suction unit, the contents injection unit, the absorbent supply unit, the absorbent pressing unit, the edge member supply unit, and the absorbent fixing unit are sequentially installed in the feeding table along a feeding direction of the cosmetics container.

The absorbent supply unit includes: a pair of guide rails installed along a first direction that is a feeding direction of the cosmetics container and a second direction perpendicular to the first direction; a pair of slide coupling units slidably coupled to the pair of guide rails; an elevation unit opposite ends of which are coupled to the slide coupling unit to be movable vertically, respectively; and an absorbing unit installed at a lower portion of the elevation unit, for applying a suction force when an actuator associated with the absorbing unit is operated.

The absorbent pressing unit includes: a press body fixed to the feeding table;

an actuator installed in the press body and having a vertically movable actuating unit; and a pressing unit coupled to a lower end of the actuating unit, for pressing the absorbent while being inserted into the accommodation space of the cosmetics container when the actuating unit is moved downwards.

The absorbent pressing unit further includes at least one resilient shaft installed between the press body and the pressing unit to extend when the pressing unit is moved downwards.

The edge member supply unit includes: a pair of guide rails installed along a first direction that is a feeding direction of the cosmetics container and a second direction perpendicular to the first direction; a pair of slide coupling units slidably coupled to the pair of guide rails; an elevation unit opposite ends of which is coupled to the slide coupling unit to be movable vertically, respectively; and a nipper installed at a lower portion of the elevation unit, for gripping the edge member or releasing the gripped state of the edge member while gathering or widening according to an operation of an actuator associated with the nipper.

The apparatus further includes a cosmetics container releasing unit for supplying the cosmetic container in which the absorbent is fixed to the accommodation space by the absorbent fixing unit to a feeding line connected to another process.

The cosmetics container releasing unit includes: a guide rail formed lengthily along the same direction as a forward direction of the conveyor belt of the feeding table; a sliding member slidably coupled to the guide rail; and a nipper coupled to the sliding member, for gripping the cosmetic container or releasing a gripped state of the cosmetics container while widening or gathering according to an operation of an actuator associated with the nipper.

Advantageous Effects

According to the present invention, a process of absorbing relatively viscous contents by an absorbent is applied to all products at the same intensity every time and the process is completely automated, so that an absorption degree of contents to the absorbent of the manufactured cosmetics can be always constantly maintained within a predetermined error range.

Furthermore, a process of suctioning foreign substances from a cosmetics container before contents and an absorbent are introduced, a finally produced product can be basically protected from a degradation of the product due to foreign substances as the corresponding process is performed through an automation process, and an unmanned process can be performed without consuming labor power.

BEST MODE

Mode for Invention

Hereinafter, a cosmetics manufacturing apparatus including a process of absorbing contents by an absorbent according to an embodiment of the present invention will be described in detail with reference to the accompanying drawings.

Figure 1:
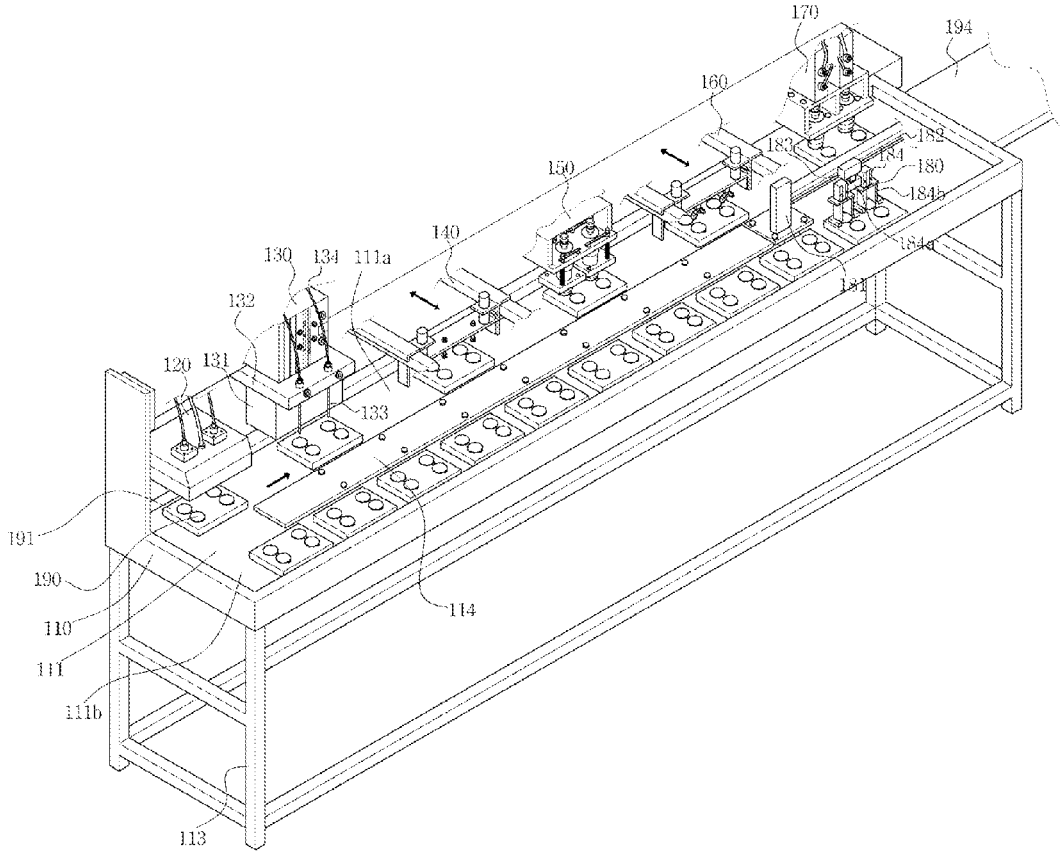
FIG. 1 is a perspective view showing a cosmetics manufacturing apparatus including a process of absorbing contents by an absorbent according to an embodiment of the present invention.

FIG. 1 is a perspective view showing a cosmetics manufacturing apparatus including a process of absorbing contents by an absorbent according to an embodiment of the present invention.

As shown, the cosmetics manufacturing apparatus 100 including a process of absorbing contents by an absorbent according to the embodiment of the present invention (hereinafter, referred to as "a cosmetics manufacturing apparatus") includes a feeding table 110, a suction unit 120, a contents injection unit 130, an absorbent supply unit 140, an absorbent pressing unit 150, a edge member supply unit 160, and an absorbent fixing unit 170. The cosmetics manufacturing apparatus according to the embodiment of the present invention may further include a cosmetics container releasing unit 180.

The feeding table 110 is configured such that the cosmetics container 190 for packaging contents is fed through an upper portion thereof, and thus a conveyor belt 111 is installed on an upper surface of the feeding table 110. In the embodiment of the present invention, the feeding table 110 includes a leg 113 for separating the feeding table 110 from a bottom surface of a working place by a predetermined distance.

The conveyor belt 111 is installed on the upper surface of the feeding table 110, and a central separation bar 114 is installed in the feeding table 110 along a lengthwise direction of the feeding table 110 in the embodiment of the present invention. A first conveyor belt 111*a* and a second conveyor belt 111*b* are installed with respect to the central separation bar 114 to be operated in opposite directions. Referring to the drawings, the first conveyor belt 111*a* functions to sequentially move the cosmetics container 190 from a suction unit 120 that will be described below toward an absorbent fixing unit 170. The second conveyor belt 111*b* is operated in a direction opposite to a direction of the first conveyor belt 111*a* to function to supply the cosmetics container 190 to the first conveyor belt 111*a*. The cosmetics container 190 is fed while being held in a movable block 191.

The suction unit 120 functions to suction dust and other foreign substances existing in an accommodation space of the cosmetics container 190. That is, the suction unit 120 cleans an interior of the accommodation space before contents are injected into the accommodation space of the cosmetics container 190. Although it has been exemplified in the embodiment of the present invention that the suction unit 120 is fixedly installed in the feeding table 110, the present invention is not limited thereto but the suction unit 120 may be installed at various locations in various formed within a range for providing a suction force to the accommodation space of the cosmetics container 190.

Figure 2:
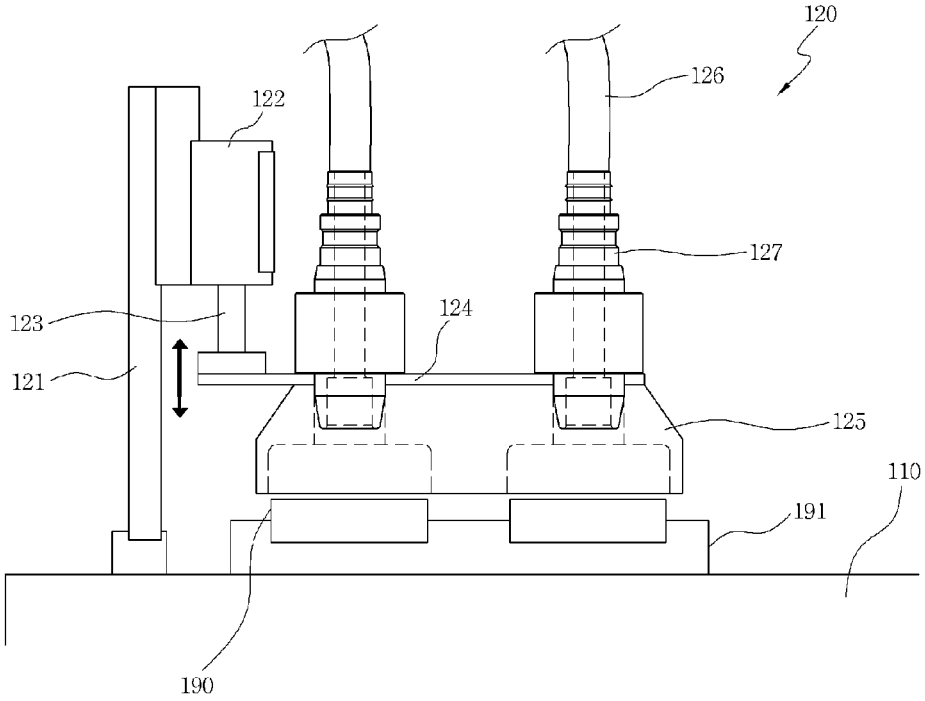
FIG. 2 is a view showing a structure and an operation state of a suction unit of the cosmetics manufacturing apparatus according to the embodiment of the present invention.

FIG. 2 is a view showing a structure and an operation state of the suction unit 120. Referring to FIG. 2, the suction unit 120 includes a support post 212, an actuator 122, an elevation unit 124, a suction cover 125, a hydraulic pump (not shown), and a hydraulic hose 126.

The support post 121 is erected at an upper portion of the feeding table 110, and the actuator 122 is installed at an upper portion of the support post 121. Here, the actuator 122 is a hydraulic cylinder or a pneumatic cylinder, and the elevation unit 124 is coupled to a cylinder rod 123 of the actuator 124. The elevation unit 124 is installed in parallel to the upper surface of the feeding table 123, and the suction cover 125 is coupled to a lower portion of the elevation unit 124 and thus the suction cover 125 is moved as the elevation unit 124 elevates. That is, the suction cover 125 reciprocates between a location where the suction cover 125 suctions foreign substances in the accommodation space of the cosmetics container 190 at an upper portion of the cosmetics container 190 and a location the suction cover 125 is moved upwards again while being separated from the cosmetics container 190.

The hydraulic hose 126 is connected to an upper portion of the suction cover 125, and one end of the hydraulic hose 126 is connected to a hydraulic pump (not shown) and an opposite end of the hydraulic hose 126 generates a suction force. That is, the opposite end of the hydraulic hose 126 is connected to the suction cover 125 while being communicated with an interior space of the suction cover 125. Accordingly, the opposite end of the hydraulic hose 16 provides a suction force to the interior space of the suction cover 125 according to an operation of the hydraulic pump.

Referring back to FIG. 1, the contents injection unit 130 will be described. The contents injection unit 130 functions to inject cosmetic contents into an accommodation space from which foreign substances of the cosmetics container 190 are removed. In the embodiment of the present invention, the cosmetic contents provide at least two complex functions such as whitening, blocking of UV rays, a cooling effect, and a makeup base function. Although relatively viscous contents such as "sun block" have been exemplified as the cosmetic contents, the present invention is not limited thereto.

In the embodiment of the present invention, the contents injection unit 130 includes a support post 131, a nozzle installation unit 132, an injection nozzle 133, an actuator (not shown), a connecting hose 134.

The support post 131 is erected at an upper portion of the feeding table 110, and the nozzle installation unit 132 is coupled to an upper portion of the support post 131. One end of the injection nozzle 133 is connected to a lower portion of the nozzle installation unit 132 and an opposite end of the injection nozzle 133 extends downwards toward the feeding table 133 to be close to the accommodation space of the cosmetics container 190. One end of the connecting hose 134 is connected to a storage tank (not shown) for the cosmetic contents and an opposite end thereof is connected to the injection nozzle 133 through the nozzle installation unit 132. That is, the cosmetic contents in the storage tank is supplied to the injection nozzle 133 through the connecting hose 134 according to an operation of the actuator (not shown).

Next, the absorbent supply unit 140 will be described. The absorbent supply unit 140 functions to introduce an absorbent 192 into the accommodation space of the cosmetic container 190, and then the accommodation space of the cosmetics container 190 accommodates cosmetic container.

Figure 3:
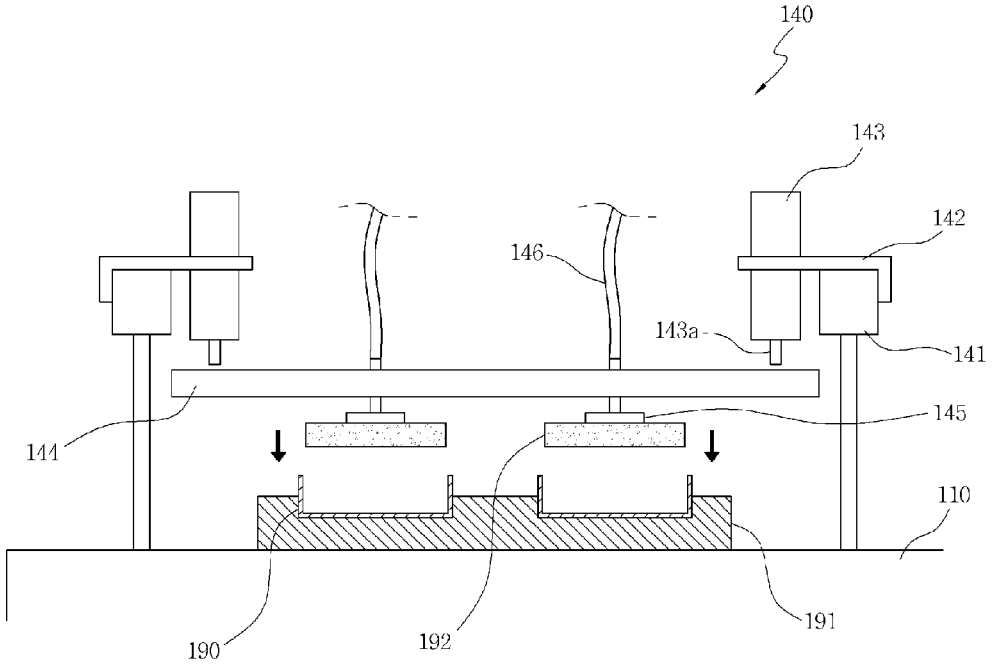
FIG. 3 is a view showing a structure and an operation state of an absorbent supply unit of the cosmetics manufacturing apparatus according to the embodiment of the present invention.

FIG. 3 is a view showing a structure and an operation state of the absorbent supply unit 140. Referring to FIG. 3, the absorbent supply unit 140 includes a pair of guide rails 141, a pair of slide coupling units 142, a pair of actuators 143, an elevation unit 144, a suction unit 145, a hydraulic pump (not shown), and a hydraulic hose 146.

The pair of guide rails 141 are installed in parallel to each other along a first direction, that is, a feeding direction of the cosmetics container 190 and a second direction perpendicular to the first direction, respectively. The pair of slide coupling units 142 are slidably coupled to the pair of guide rails 141, respectively. The pair of actuators 143 are coupled to the pair of slide coupling units 142. In the embodiment of the present invention, the actuators 143 are hydraulic cylinders, and opposite lengthwise ends of the elevation unit 144 are coupled to the cylinder rods 143*a* of the actuators 143, respectively.

That is, the elevation unit 144 is disposed in a direction parallel to the upper surface of the feeding table 110, and the elevation unit 144 reciprocates between a location close to the feeding table 110 and a location separated from the feeding table 110 as the actuators 143 operate and the cylinder rods 143*a* moves vertically accordingly. The suction unit 145 is installed at a lower portion of the elevation unit 144. The suction unit 145 is moved to an upper portion of the accommodation space of the cosmetics container 190 as the slide coupling unit 142 and the elevation unit 144 move after suctioning the absorbent 192 (generally, sponge) kept outside the feeding table 110, in which state the absorbent 192 drops into the accommodation space through solving the suction force. Thereto, the hydraulic hose 146 is connected to an upper portion of the suction unit 145. One end of the hydraulic hose 146 is connected to a hydraulic pump (not shown) and an opposite end thereof generates a suction force. The suction unit 145 is connected to an opposite end of the hydraulic hose 146.

Referring back to FIG. 1, the absorbent pressing unit 150 will be described. The absorbent pressing unit 150 repeatedly presses the absorbent 192 in the accommodation space of the cosmetics container 190 several times, and accordingly, the absorbent 192 repeatedly contracts and returns to an original shape to absorb the cosmetic contents in the accommodation space. That is, the absorbent pressing unit 150 performs a kneading function of absorbing the cosmetic contents in the absorbent 192.

Figure 4:
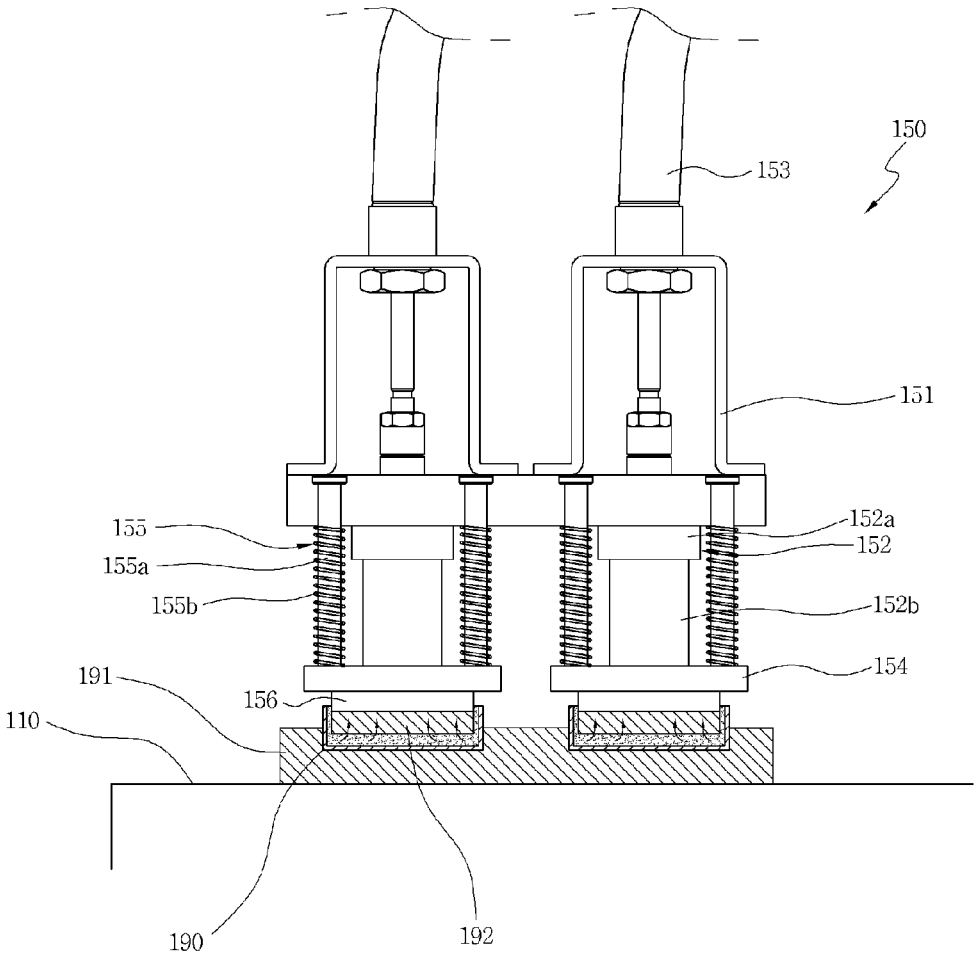
FIG. 4 is a view showing a structure and an operation state of an absorbent pressing unit of the cosmetics manufacturing apparatus according to the embodiment of the present invention.

FIG. 4 is a view showing a structure and an operation state of the absorbent pressing unit 150. Referring to FIG. 4, the absorbent pressing unit 150 includes a press body 151, an actuator 152, a hydraulic hose 153, a resilient shaft support unit 154, a resilient shaft 155, and a pressing unit 156. That is, although it has been exemplified that the absorbent pressing unit 150 is a press in the embodiment, the present invention is not limited thereto but the absorbent pressing unit 150 may be carried out in various forms within a range in which a condition of absorbing the cosmetic contents by the absorbent 192 by pressing the absorbent 191 in the accommodation space of the cosmetics container 190 a plurality of times.

Referring to FIG. 4, a press body 151 of the absorbent pressing unit 150 is installed at an upper portion of the feeding table 110. The actuator 152 is installed in the press body 151, and the actuator 152 is a hydraulic cylinder in the embodiment of the present invention. That is, the actuator 152 includes a body 152*a* fixed to the press body 151 and an actuating unit 152*b* coupled to the body 152*a* to be moved vertically. One end of the hydraulic hose 153 is connected to an upper portion of the body 152*a*, and an opposite end of the hydraulic hose 153 is connected to a hydraulic pump (not shown) to transfer a pressure due to an operation of a hydraulic pump to the actuator 152.

The resilient shaft support unit 154 is coupled to a lower end of the actuating unit 152*b* of the actuator 152, and accordingly, the resilient shaft support unit 154 is vertically moved as the actuating unit 152*b* moves vertically. The resilient shaft 155 is installed between the press body 151 and the resilient shaft support unit 154, and the resilient shaft 155 is restored when the actuating unit 152*b* moves upwards after being extended when the actuating unit 152*b* moves downwards. Then, the resilient shaft 155 provides a force upwards to the actuating unit 152*b* in the restoring process, and accordingly, the actuating unit 152*b* may be moved upwards with a relatively low hydraulic pressure, considering that the actuating unit 152*b* is not influenced at all by a resilient function of the resilient shaft 155 when being moved upwards. In the embodiment of the present invention, the resilient shaft 155 includes a shaft 155*a* and a spring 155*b*. That is, opposite lengthwise ends of the shaft 155*a* are coupled to the press body 151 and the resilient shaft support unit 154, respectively, and are installed such that the coil spring 155*b* is mounted on the shaft 155*a*.

The pressing unit 156 is coupled to a lower portion of the resilient shaft support unit 154, and the pressing unit 156 is inserted into the accommodation space of the cosmetics container 190 to perform a function of compressing and releasing the absorbent 192. That is, the pressing unit 156 repeatedly presses the absorbent 192 several times, and accordingly, the absorbent 192 absorbs the cosmetic contents in the accommodation space while repeatedly contracting and returning to the original shape.

Referring back to FIG. 1, the edge member supply unit 160 will be described. The edge member supply unit 160 functions to introduce the edge member 166 into the accommodation space of the cosmetic container 190. Then, the absorbent 192 in the accommodation space of the cosmetics container 190 already completely absorbs the cosmetic contents. The edge member 166 is fixed to the accommodation space while pressing a periphery of the absorbent 192 to perform a function of fixing the absorbent 192 to the accommodation space of the cosmetics container 190.

Figure 5A:
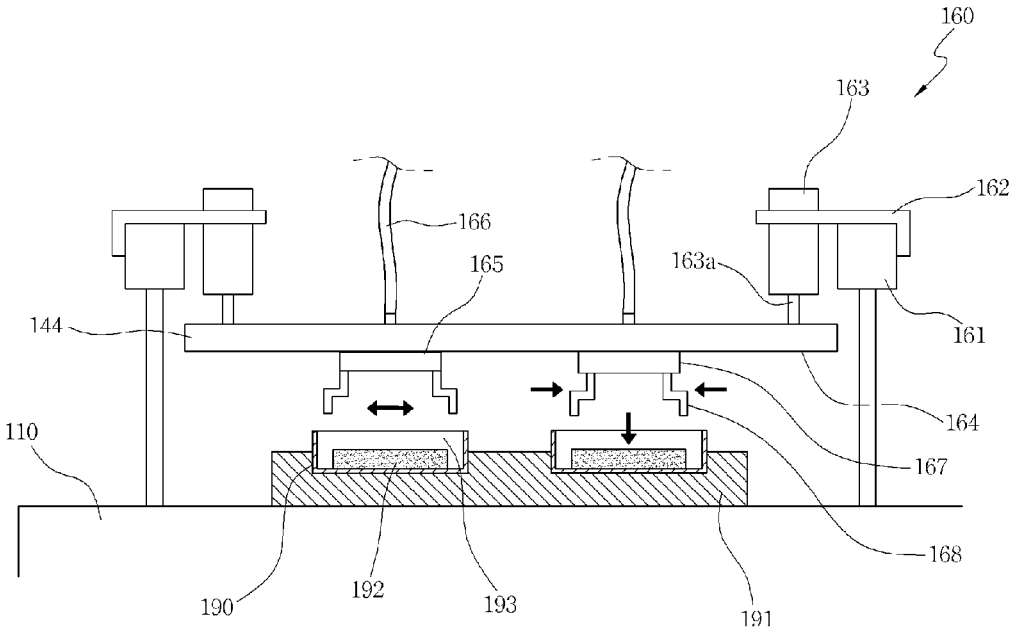
FIGS. 5A and 5B are views showing a structure and an operation state of a edge member supply unit of the cosmetics manufacturing apparatus according to the embodiment of the present invention.
Figure 5B:
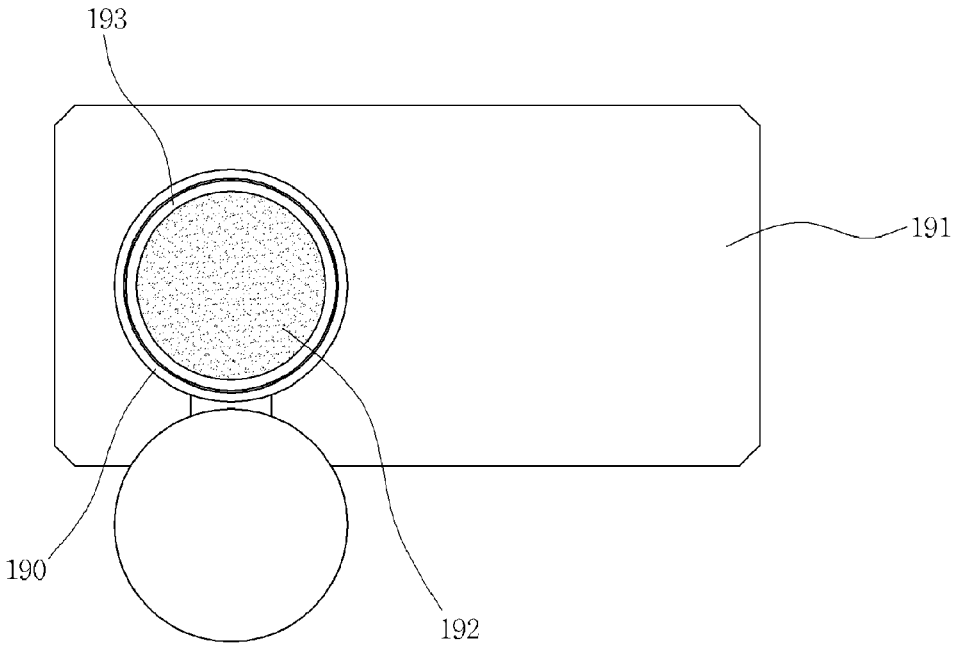

Referring to FIGS. 5A and 5B, the edge member supply unit 160 includes a pair of guide rails 161, a slide coupling unit 162, a first actuator 163, an elevation unit 164, a connecting unit 165, a hydraulic hose 166, a second actuator 167, and a nipper unit 168. That is, the edge member supply unit 160 is similar to the absorbent supply unit 140 described with reference to FIG. 3 in its entire configuration, but differs from the absorbent supply unit 140 in that the edge member supply unit 160 further includes the connecting unit 165, the second actuator 167, the hydraulic hose 166 connected to the second actuator 167, and the nipper unit 168.

Thus, the same parts of the edge member supply unit 160 as the absorbent supply unit 140 may be understood with reference to the description of the absorbent supply unit 140 described with reference to FIG. 3, and the connecting unit 165, the second actuator 167, the hydraulic hose 166 connected to the second actuator 167, and the nipper unit 168 will be mainly described below.

The connecting unit 165 is coupled to a lower portion of the elevation unit 164, and the second actuator 167 is installed in the connecting unit 165. One end of the hydraulic hose 166 is connected to a hydraulic pump (not shown) and an opposite end thereof is connected to the elevation unit 164 to provide a hydraulic pressure to the second actuator 167. The second actuator 167 is connected to the connecting unit 165, and reciprocates the nipper unit 168 between a location where the nipper 168 gathers and a location where the nipper 168 widens through an operation thereof. Although it has been exemplified that the second actuator 167 is a hydraulic cylinder in the embodiment of the present invention, the present invention is not limited thereto. Finally, the nipper unit 168 grips the edge member 193 or releases the gripped state of the edge member 193 through an operation of the second actuator 167. In more detail, referring to FIG. 5A, the right nipper part 168 of FIG. 5A grips the edge member 193 to feed the edge member 193 to an upper portion of the accommodation space of the cosmetics container 190, and the left nipper part 168 of FIG. 5A releases the gripped state of the edge member 193 in the state of the right nipper part 168 and accordingly, the edge member 193 is introduced into the accommodation space of the cosmetics container 190.

FIG. 5B is a plan view taken from an upper side of the cosmetics container 190, showing a state in which the edge member 193 is introduced into the accommodation space of the cosmetics container 190 as the left nipper part 168 of FIG. 5A releases the gripped state of the edge member 193.

Referring back to FIG. 1, the absorbent fixing unit 170 will be described. The absorbent fixing unit 170 functions to press the edge member 193 and fix the edge member 193 to an interior of the accommodation space of the cosmetics container 190, in which case the edge member 193 is fixed to the interior of the accommodation space of the cosmetics container 190 while a circumference of the absorbent 192 being pushed and pressed. That is, the absorbent fixing unit 170 functions to fix the edge member 193 and the absorbent 192 while integrating the edge member 193 and the absorbent 192.

Figure 6:
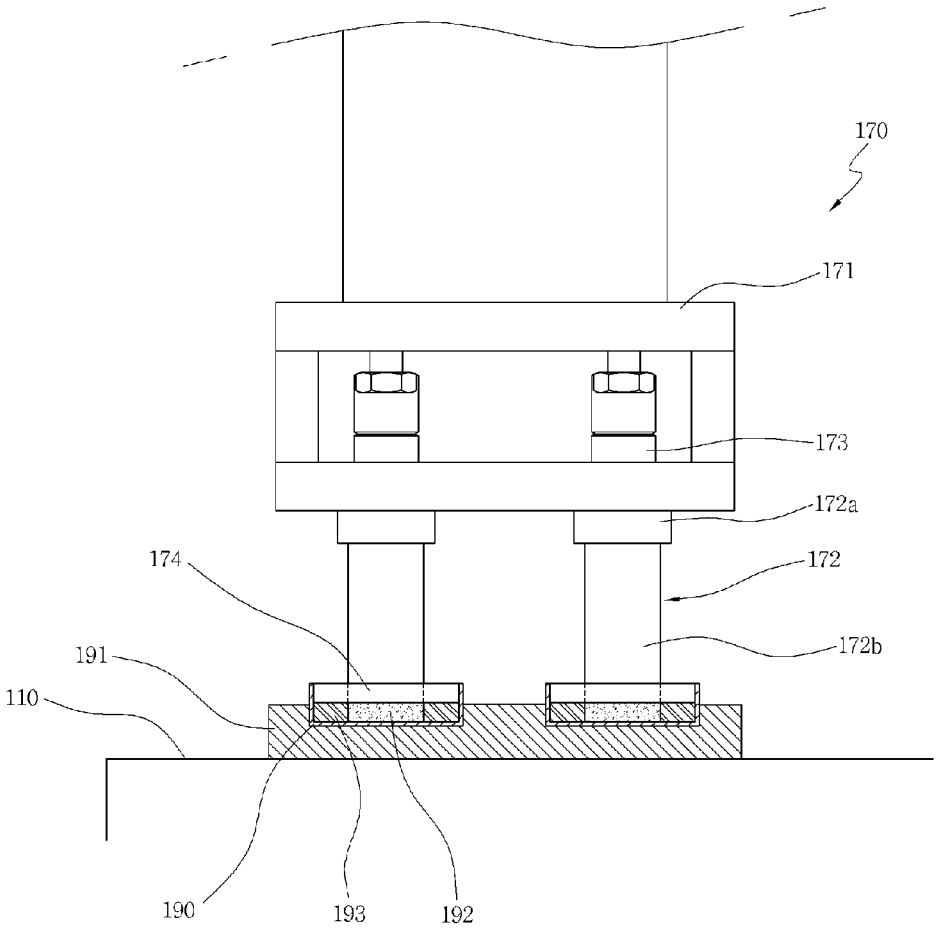
FIG. 6 is a view showing a structure and an operation state of an absorbent fixing unit of the cosmetics manufacturing apparatus according to the embodiment of the present invention.
Figure 7:
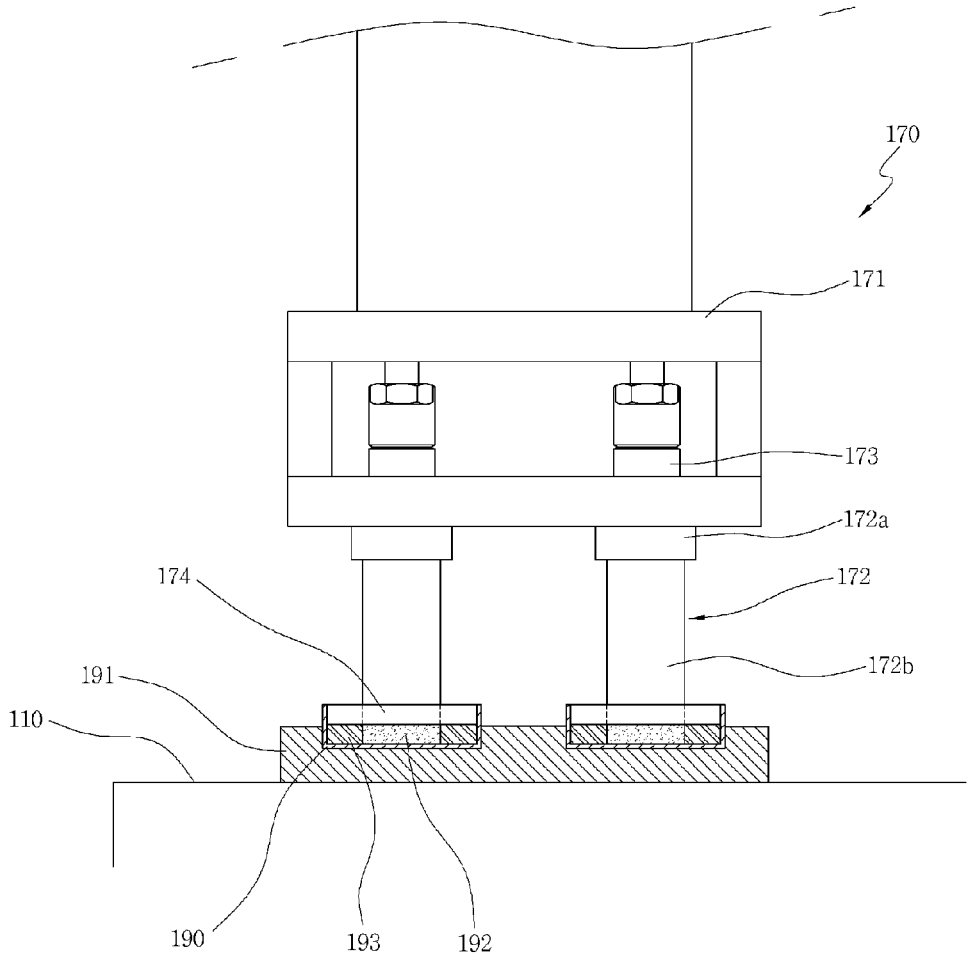
FIG. 7 shows the press body, actuator having body and actuating unit, hydraulic hose, pressing member, movable block, absorbent, and feeding table.

Referring to FIG. 6, the absorbent fixing unit 170 includes a press body 171, an actuator 172, a hydraulic hose 173, and a pressing member 174. That is, although it has been exemplified that the absorbent fixing unit 170 is a press, the present invention is not limited thereto but the absorbent fixing unit 170 may be carried out in various forms within a range satisfying a condition of fixing the edge member 193 to the accommodation space together with the absorbent 192 by pressing the edge member 193 in the accommodation space of the cosmetics container 190.

Referring to FIG. 6, the press body 171 of the absorbent fixing unit 170 is installed at an upper portion of the feeding table 110. The actuator 172 is installed in the press body 171, and the actuator 172 is a hydraulic cylinder in the embodiment of the present invention. That is, the actuator 172 includes a body 172*a* fixed to the press body and an actuating unit 172*b* coupled to the body 172*a* and moved vertically. One end of the hydraulic hose 173 is connected to an upper portion of the body 172*a* and an opposite end of the hydraulic hose 173 is connected to a hydraulic pump (not shown) to function to transfer a pressure due to an operation of the hydraulic pump to the actuator 172.

The pressing member 174 is coupled to a lower portion of the actuating unit 172*b* and is moved vertically as the actuating unit 172*b* moves vertically. The pressing member 174 is a part that actually presses the edge member 193. Thus, the pressing member 174 is the same as or similar to the edge member 193. That is, the pressing member 174 presses and fixes the edge member 193 introduced into the accommodation space to the accommodation space while being inserted into the accommodation space of the cosmetics container 190. Here, the edge member may be fixed to the accommodation space by using various known technologies such as a coupling method by a recess and a boss or an undercut coupling method, and thus a detailed description thereof will be omitted in the embodiment of the present invention.

Referring back to FIG. 1, the cosmetics container releasing unit 180 will be described. The cosmetics container releasing unit 180 functions to supply the cosmetics container having undergone a series of processes from the suction unit 130 to the absorbent fixing unit 170 to a feeding line 194 connected to other processes. That is, after the absorbent 192 is fixed to the accommodation space through the absorbent fixing unit 170, the cosmetics container 190 is carried to the feeding line 194 for supplying the cosmetics container 190 to another process by the cosmetics container releasing unit 180, and accordingly, the cosmetics container 190 is fed along the feeding line 194 to be moved to a working space of a semiautomatic or manual process for the other process.

In more detail, the cosmetics container releasing unit 180 includes a support post 181, a guide rail 182, a sliding member 183, and a container carrying unit 184. The container carrying unit 184 includes an actuator 184 and a nipper 184*b*.

The support post 181 is erected on an upper surface of the feeding table 110, and one end of the guide rail 182 is coupled to the support post 181 and an opposite end thereof extends in the same direction as that of the feeding table 110. The sliding member 183 is slidably coupled to the guide rail 182 along a lengthwise direction of the guide rail 182, and the container carrying unit 184 is coupled to the sliding member 183. The actuator 184*a* of the container carrying unit 184 reciprocates the nipper 184*b* between a location where the nipper 184*b* gathers and a location where the nipper 184*b* widens through an operation thereof. Although it has been described that the actuator 184*a* is a hydraulic cylinder in the embodiment of the present invention, the present invention is not limited thereto. Finally, the nipper 184*b* grips the cosmetics container 190 or releases the gripped state of the cosmetics container 190 through an operation of the actuator 184*a*.

That is, the cosmetics container releasing unit 180 carries the cosmetics container 190 to the feeding line 194 connected to another process from the feeding table 110 while the sliding member 183 reciprocates between an upper portion of the feeding table 110 and the feeding line 194 connected to another process along the guide rail 182 and the nipper 184*b* grips and releases the cosmetics container 190.

Hereinafter, an operation of the cosmetics manufacturing apparatus according to the embodiment of the present invention will be described briefly.

First, the cosmetics container 190 fed along the belt conveyor 111 of the feeding table 110 is stopped at a lower portion of the suction unit 120. Thereafter, the suction unit 120 is operated to suction foreign substances from the accommodation space of the cosmetics container 190. The cosmetics container 190 is moved along the belt conveyor 111 again and is stopped at a lower portion of the absorbent introducing unit 140. Thereafter, the absorbent introducing unit 140 is operated to introduce the absorbent 192 into the accommodation space of the cosmetics container 190. Then, the cosmetic contents are filled in the accommodation space of the cosmetics container 190.

The cosmetic container 190 is moved along the conveyor belt 111 again and is stopped at a lower portion of the absorbent pressing unit 150. Thereafter, the absorbent pressing unit 150 repeatedly presses the absorbent 192 in the accommodation space of the cosmetics container 190 a plurality of times to allow the absorbent 192 to be completely absorb the cosmetic contents. The cosmetics container 190 is moved along the belt conveyor 111 again and is stopped at a lower portion of the edge member introducing unit 160. Thereafter, the edge member introducing unit 160 introduces the edge member 193 into the accommodation space of the cosmetics container 190. Then, the absorbent 193 in the accommodation space of the cosmetics container 190 completely absorbs the cosmetic contents. The cosmetics container 190 is moved along the belt conveyor 111 again and is stopped at a lower portion of the absorbent fixing unit 170. Thereafter, the absorbent fixing unit 170 presses the edge member 193 in the accommodation space of the cosmetics container 190 to fix the edge member 193 to the accommodation space and allow the edge member 193 to fix the absorbent 192 to the accommodation space at the same time.

The cosmetics container 190 that fixes the absorbent 192 to the accommodation space is carried to the feeding line 194 for another process through an operation of the cosmetics container releasing unit 180.

As can be seed from the embodiment of FIGS. 1 to 6, according to the cosmetics manufacturing apparatus according to the present invention, a kneading process of absorbing relatively viscous cosmetic contents is applied to all products at the same intensity every time and an absorption degree of the absorbent 192 for the cosmetic contents can be always constantly maintained in a predetermined error range. Further, the cosmetic contents can be completely absorbed by the absorbent 193 while cosmetic contents of various viscosities and the absorbent 193 having various porosities are compatible by adjusting the number of repetitions of the pressing operations of the absorbent pressing unit 150 to a predetermined number, considering the viscosity of the contents and the porosity of the absorbent 193.

Until now, an embodiment of the present invention for carrying out the cosmetics manufacturing apparatus including a process of absorbing contents by an absorbent according to the present invention has been described. However, the present invention is not limited to the embodiment, but it will be appreciated that those skilled in the art to which the present invention pertains can variously modify the present invention without departing from the spirit of the present invention.

DESCRIPTION OF REFERENCE SYMBOLS

100: Cosmetics manufacturing apparatus
110: Feeding table
111: Conveyor belt
111*a*: First conveyor belt
111*b*: Second conveyor belt
113: Leg
114: Central separation bar
120: Suction unit
121: Support post
122: Actuator
123: Cylinder rod
124: Elevation unit
125: Suction cover
126: Hydraulic hose
130: Contents injection unit
131: Support post
132: Nozzle installation unit
133: Injection nozzle
134: Connecting hose
140: Absorbent supply unit
141: Guide rail
142: Slide coupling unit
143: Actuator
144: Elevation unit
145: Absorbing unit
146: Hydraulic hose
150: Absorbent pressing unit
151: Press body
152: Actuator
152*a*: Body
152*b*: Actuating unit
153: Hydraulic hose
154: Resilient shaft support unit
155: Resilient shaft
155*a*: Support shaft
155*b*: Resilient member
156: Pressing unit
160: Edge member supply unit
161: Guide rail
162: Slide coupling unit
163: First actuator
163*a*: Cylinder rod
164: Elevation unit
165: Connecting unit
166: Hydraulic hose
167: Second actuator
168: Nipper
170: Absorbent fixing unit
171: Press body
172: Actuator
172*a*: Body
172*b*: Actuating unit
173: Hydraulic hose
174: Pressing member
180: Cosmetics container releasing unit
181: Support post
182: Guide rail
183: Sliding member
184: Container carrying unit
184*a*: Actuator
184*b*: Nipper
190: Cosmetics container
191: Movable block
192: Absorbent
193: Edge member
194: Feeding line

The invention claimed is:

1. A cosmetics manufacturing apparatus comprising a process of absorbing contents by an absorbent, the apparatus comprising:

a feeding table by which a cosmetics container is fed;

a suction unit for suctioning foreign substances from an accommodation space of the cosmetics container;

a contents injection unit for injecting contents into the accommodation space from which the foreign substances are suctioned by the suction unit;

an absorbent supply unit for introducing an absorbent into the accommodation space into which the contents are injected by the contents injection unit;

an absorbent pressing unit for repeatedly pressing the absorbent and absorbing the contents into the absorbent;

a edge member supply unit for introducing a edge member for fixing the absorbent to the accommodation space into the accommodation space; and an absorbent fixing unit for fixing the edge member to the accommodation space while the edge member presses and fixes a circumference of the absorbent.

2. The apparatus of claim 1, wherein the suction unit, the contents injection unit, the absorbent supply unit, the absorbent pressing unit, the edge member supply unit, and the absorbent fixing unit are sequentially installed in the feeding table along a feeding direction of the cosmetics container.

3. The apparatus of claim 1, wherein the absorbent supply unit comprises:

a pair of guide rails installed along a first direction that is a feeding direction of the cosmetics container and a second direction perpendicular to the first direction;

a pair of slide coupling units slidably coupled to the pair of guide rails;

an elevation unit opposite ends of which are coupled to the slide coupling unit to be movable vertically, respectively; and an absorbing unit installed at a lower portion of the elevation unit, for applying a suction force when an actuator associated with the absorbing unit is operated.

4. The apparatus of claim 1, wherein the absorbent pressing unit comprises:

a press body fixed to the feeding table;

an actuator installed in the press body and having a vertically movable actuating unit; and a pressing unit coupled to a lower end of the actuating unit, for pressing the absorbent while being inserted into the accommodation space of the cosmetics container when the actuating unit is moved downwards.

5. The apparatus of claim 4, wherein the absorbent pressing unit further comprises at least one resilient shaft installed between the press body and the pressing unit to extend when the pressing unit is moved downwards.

6. The apparatus of claim 1, wherein the edge member supply unit comprises:

a pair of guide rails installed along a first direction that is a feeding direction of the cosmetics container and a second direction perpendicular to the first direction;

a pair of slide coupling units slidably coupled to the pair of guide rails;

an elevation unit opposite ends of which is coupled to the slide coupling unit to be movable vertically, respectively; and a nipper installed at a lower portion of the elevation unit, for gripping the edge member or releasing the gripped state of the edge member while gathering or widening according to an operation of an actuator associated with the nipper.

7. The apparatus of claim 1, further comprising a cosmetics container releasing unit for supplying the cosmetic container in which the absorbent is fixed to the accommodation space by the absorbent fixing unit to a feeding line connected to another process.

8. The apparatus of claim 7, wherein the cosmetics container releasing unit comprises:

a guide rail formed lengthily along the same direction as a forward direction of the conveyor belt of the feeding table;

a sliding member slidably coupled to the guide rail; and a nipper coupled to the sliding member, for gripping the cosmetic container or releasing a gripped state of the cosmetics container while widening or gathering according to an operation of an actuator associated with the nipper.

* * * * *